US006176545B1

(12) United States Patent
Hambleton

(10) Patent No.: US 6,176,545 B1
(45) Date of Patent: Jan. 23, 2001

(54) PORTABLE STOOL

(75) Inventor: John D. Hambleton, Guthrie Center, IA (US)

(73) Assignee: Kelli Lemke, Guthrie Center, IA (US)

( * ) Notice: Under 35 U.S.C. 154(b), the term of this patent shall be extended for 0 days.

(21) Appl. No.: 09/357,108

(22) Filed: Jul. 19, 1999

(51) Int. Cl.[7] ..... A47C 9/10

(52) U.S. Cl. ..... 297/4; 297/195.11; 297/451.4; 297/451.5; 248/155; 248/155.1; 135/65; 135/66

(58) Field of Search ..... 297/4, 195.11, 297/440.1, 440.14, 440.16, 440.22, 451.4, 451.5, 451.8; 248/155, 155.1; 135/65, 66

(56) References Cited

U.S. PATENT DOCUMENTS

| | | | | |
|---|---|---|---|---|
| 401,302 | * | 4/1889 | Prudy | 297/451.4 |
| 444,621 | * | 1/1891 | Schneider | 248/155.1 |
| 1,267,953 | * | 5/1918 | Zolp | 297/4 |
| 1,709,200 | * | 4/1929 | Westbrook et al. | 297/4 X |
| 2,099,345 | * | 11/1937 | Olszanowski | 297/4 |
| 3,266,839 | * | 8/1966 | Combs | 248/155 X |
| 3,910,544 | | 10/1975 | Engstrom . | |
| 4,098,478 | * | 7/1978 | Spitzke | 297/4 X |
| 4,101,163 | * | 7/1978 | Morin | 297/4 X |
| 4,130,294 | * | 12/1978 | Walker | 248/155.1 X |
| 4,232,896 | * | 11/1980 | Caldwell | 297/4 |
| 4,632,410 | | 12/1986 | Bainbridge . | |
| 4,684,090 | * | 8/1987 | Skarland | 248/155 |
| 4,794,743 | * | 1/1989 | Lehneis | 135/65 |
| 5,411,313 | * | 5/1995 | Counihan et al. | 135/66 X |
| 5,673,966 | * | 10/1997 | Morton, Jr. | 297/451.5 X |

FOREIGN PATENT DOCUMENTS

| | | | | |
|---|---|---|---|---|
| 189537 | * | 12/1922 | (GB) | 248/155.1 |

* cited by examiner

*Primary Examiner*—Peter M. Cuomo
*Assistant Examiner*—Rodney B. White
(74) *Attorney, Agent, or Firm*—Henderson & Sturm LLP

(57) ABSTRACT

A stool having an elongated post with a top and a bottom along a generally longitudinal axis. A first threaded member is disposed at the top of the post and a second threaded member is disposed intermediate the top and bottom. The second threaded member is disposed about an axis substantially transverse to the axis of the first threaded member. A seat member having a third threaded member in or on the bottom thereof is adapted to selectively mate with the first and second threaded members so that the seat member has an operative position when the third threaded is engaged with the first threaded member and a storage position when the third threaded member is engaged with the second threaded member.

6 Claims, 1 Drawing Sheet

PORTABLE STOOL

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates generally to stools, and more particularly to a portable stool which can be used outside.

2. Description of the Related Art

People who want to sit on a chair or stool during recreational activities outside typically have an array of chairs and stools to select from. Folding lawn chairs are useful when the outdoor activity is close to home and where compactness is not a problem. When there is a concern for compactness or portability, folding stools, e.g., folding chairs with no back thereon have been used. Also, plastic buckets of the type used to package paint or the like have been used by those in the outdoors because they are cheap and light to carry. These buckets are simply turned upside down and placed on the ground to sit on and can be moved from place to place. Neither of these solutions is particularly compact and those having activities outside sometimes have other things to carry, so the need for compactness is viewed as very important, for example for activities such as hunting, fishing and gardening where other articles also need to be carried to participate in the activity as well as the stool to be used.

Consequently, there is a need for an improved stool for use outdoors which overcomes the aforementioned problems.

BRIEF SUMMARY OF THE INVENTION

The present invention relates to a stool having an elongated post with a top and a bottom and having a generally longitudinal axis. A first threaded member is disposed at the top of the post and a second threaded member is disposed intermediate the top and bottom. The second threaded member is disposed about an axis substantially transverse to the axis of the first threaded member. A seat member having a third threaded member in or on the bottom thereof is adapted to selectively mate with the first and second threaded members, the seat member having an operative position when the third threaded is engaged with the first threaded member and a storage position wherein the third threaded member is engaged with the second threaded member.

In its preferred embodiment, there is a stop member attached to the elongated post intermediate the top and bottom thereof to allow the bottom of the elongated post to penetrate the ground but only go in as far as the stop member.

An object of the present invention is to provide an improved stool.

Another object of the invention is to provide a stool which is portable and compact for use outside.

A still further object of the invention is to provide a portable stool which has a seat member which can be attached to an elongated post either on one end when in use or to the side for storage purposes.

Other objects, advantages, and novel features of the present invention will become apparent from the following detailed description of the invention when considered in conjunction with the accompanying drawings.

DETAILED DESCRIPTION OF THE INVENTION

Figure 1:
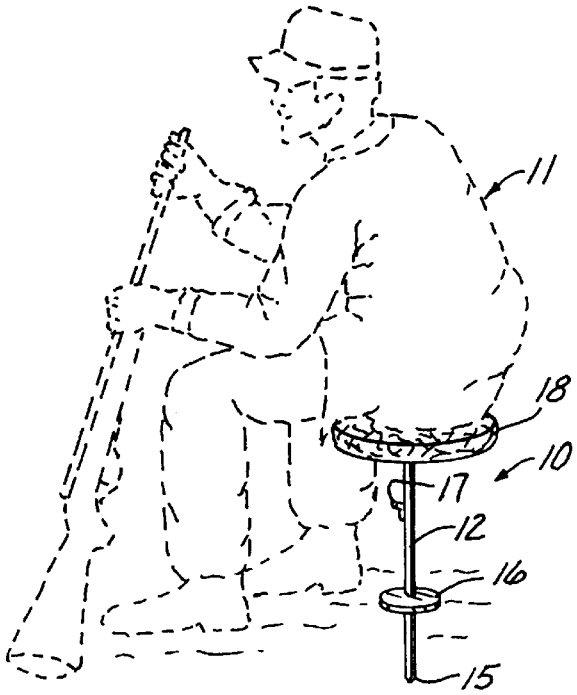
FIG. 1 is a perspective view of a preferred embodiment of the present invention in use showing a hunter in dashed lines sitting on the stool.
Figure 2:
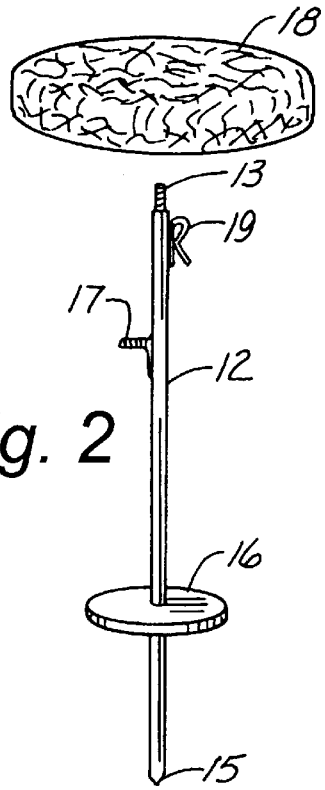
FIG. 2 is an exploded perspective view of the present invention showing the seat just before it is threaded onto an elongated rod in the operative position thereof.

Referring now to the drawings, wherein like reference numerals designate identical or corresponding parts throughout the several views, FIG. 1 shows the invention depicted generally at 10 and having a hunter 11 shown in dashed lines sitting thereon in its operative position. The stool 10 has an elongated post 12 with a top threaded member 13 thereon which is typically formed in one piece with post 12 by merely threading one end of the elongated post 12.

The bottom end 15 of the post 12 is preferably pointed although that is not an essential element of the present invention. A disc shaped stop member 16 is welded to an intermediate portion of the post 12 for reasons which will be explained below.

A second threaded member 17 is welded to the side of the post 12 so that the seat member 18 can be attached for storage purposes.

A clip member 19 is welded to the elongated post 12 and is optional depending upon whether the user wishes to be able to hang the portable stool when storing it.

Figure 3:
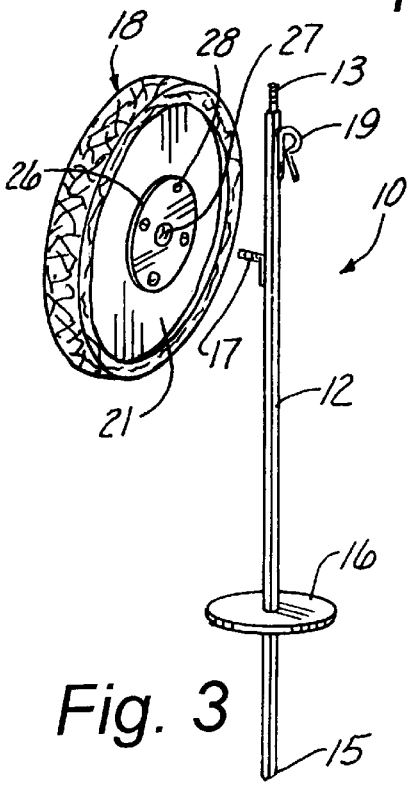
FIG. 3 is an exploded perspective view of the present invention showing the seat in readiness to be attached to an elongated post in the storage position thereof.
Figure 4:
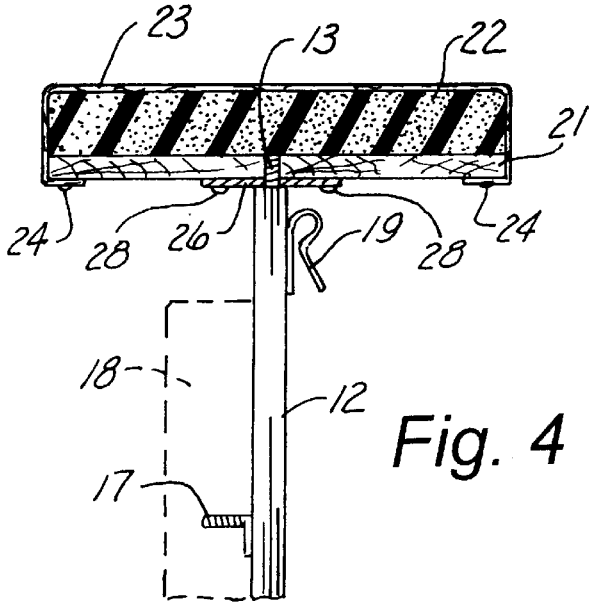
FIG. 4 is an enlarged partial cross sectional view showing the seat in solid lines in the operative position on one end of the elongated post and in dashed lines in the storage position of the seat.

Referring to FIGS. 3 and 4, the seat 18 is shown with a wooded base portion 21 and a foam rubber or foam plastic portion 22. A cover of cloth 23 or plastic covers the foam 22 and is attached along the bottom periphery of by tacks, nails or screws 24 to the circular wooden base 21.

Also, attached to the wooden base 21 is a plate 26 which is threaded in the center thereof at opening 27. This plate 26 is also attached by screws 28 to the wooden base 21.

In operation, the seat 10 would be in a storage configuration such as shown in dashed lines in FIG. 4 and shown slightly exploded therefrom in FIG. 3 wherein the threaded member 17 is threadably disposed within the threaded member 27 as shown in dashed lines in FIG. 4. The hunter 11 or other outdoor participant would merely carry the portable stool 10 to a destination and then unthread the seat 18 from the threaded member 17 and reattach it to the top threaded member 13 in the positions shown in FIGS. 1 and 4. Then the seat is grasped and the end 15 is pushed into the ground until the stop 16 hits the top of the ground, at which time the stool 10 is in a position to be used, for example in the manner shown in FIG. 1.

Of course, there can be many variations of the portable stool as shown in the drawings and still be within the scope of the claims below. For example, the length of the rod 12 between the threaded member 13 and the stop 16 can be changed. For example, such distance between threaded member 13 and stop 16 is preferred to be much shorter if used by someone using it in a garden than it would be for someone using it as a hunting stool as depicted in FIG. 1.

Similarly, the orientation of the top threaded member 13 could be slightly different, although it generally should have a somewhat vertical axis. However oriented, member 13 just needs to be coordinated with the threads 17 so that the seat 18 of the stool would be positioned mostly in a horizontal position in use regardless of the axes of the threaded member 27 and 13, i.e., the axes of threaded members 13 and 27 could be adjusted with respect to the top of the seat to produce a more or less horizontal seating surface of seat 18 without these axes of threaded member 13 and 27 being precisely vertical in the position shown in FIG. 1.

Obviously, many modifications and variations of the present invention are possible in light of the above teachings. It is therefore to be understood that, within the scope of the appended claims, the invention may be practiced otherwise than as specifically described.

I claim:

1. A stool comprising:

an elongated post having a top and a bottom and a generally longitudinal axis;

a first fixedly attached externally threaded member disposed on the top of said post;

a second fixedly attached externally threaded member attached to said post intermediate the top and bottom thereof, said second threaded member being disposed about an axis substantially transverse to the axis of the first threaded member; and, a seat member having a third internally threaded member disposed in the bottom thereof, said third threaded member being adapted to threadedly engage the first and second threaded members, said seat member having an operative position wherein said third threaded member is threadedly engaged with said first threaded member and a storage position wherein said third threaded member is threadedly engaged with said second threaded member.

2. The stool of claim 1 wherein said bottom end of said elongated post is adapted to be disposed into soil.

3. The stool of claim 2 including a stop member attached to said elongated post intermediate the top and bottom thereof for substantially controlling the height of the stool wherein the stop member is contacting the soil preventing the bottom end of the elongated member from going further into the soil than to the stop member.

4. The stool of claim 1 including a hook on said elongated post for permitting said stool to be hung up for storage.

5. The stool of claim 1 including padding on the top of the seat member.

6. The stool of claim 1 wherein said first eternally threaded member is disposed about an axis which is substantially coincident with or substantially parallel to said longitudinal axis.

* * * * *